United States Patent [19]

Menzies et al.

[11] 4,264,899

[45] Apr. 28, 1981

[54] PORTABLE ALARM FOR ENTRY DETECTION

[76] Inventors: John I. Menzies; Maureen Menzies, both of 49 Almay St., Kenmore, Queensland, Australia, 4069

[21] Appl. No.: 64,506

[22] Filed: Aug. 7, 1979

[30] Foreign Application Priority Data

Sep. 1, 1978 [AU] Australia ..... PD5776

[51] Int. Cl.[3] ..... G08B 13/08

[52] U.S. Cl. ..... 340/546; 200/61.52; 340/689; 340/693

[58] Field of Search ..... 340/546, 547, 689, 693; 200/61.52; 335/205

[56] References Cited

U.S. PATENT DOCUMENTS

| | | | |
|---|---|---|---|
| 3,488,651 | 1/1970 | Brenner | 340/546 |
| 3,601,729 | 8/1971 | Hierta | 200/61.52 |

*Primary Examiner*—Glen R. Swann, III

*Attorney, Agent, or Firm*—Schwartz, Jeffery, Schwaab, Mack, Blumenthal & Koch

[57] ABSTRACT

A portable alarm consists of a unit which emits an alarm signal when it is tilted to a predetermined extent from its upright position, and having a base support which will support the unit in a condition of unstable equilibrium, and a stay which, when the unit is stood substantially upright near to a door, for example, may be rested against the door to impart stability to the unit, which will fall from the upright position and emit the alarm signal if the door is opened to move the stay.

5 Claims, 6 Drawing Figures

PORTABLE ALARM FOR ENTRY DETECTION

BACKGROUND OF THE INVENTION

This invention relates to a portable alarm.

It is very common for thieves to obtain keys by means of which they can gain entry to hotel and motel rooms and steal valuables while the occupants are asleep. The present invention has been devised with the principal object of providing a simple low-cost portable alarm for use particularly by travellers, and which may be quickly and easily set up at a doorway to emit an alarm signal if the door should be moved appreciably from fully closed position.

An alarm, to achieve this object, should be one which does not require to be attached by screws or the like to doors or door surrounds, which will be applicable to all of the many kinds and designs of doors and their surrounds, which will not be capable of being rendered inactive by a thief before unlocking a door, and which will not be set off by an article, such as a morning newspaper, pushed under a door into a room. Such an alarm, furthermore, should be of light and compact construction, so as to be conveniently portable.

BRIEF SUMMARY OF THE INVENTION

The invention achieves the foregoing object by providing a compact and readily portable alarm which consists of a unit capable of emitting an alarm signal, normally audible, and which has base support means for supporting it, when upright, in a state of unstable equilibrium so that, if not otherwise supported, it will fall to a lying position. In this additional support the unit has stay means for resting against a door or the like to impart stability to the unit when it is supported in an upright or nearly upright position by the base support means. When the unit is moved to a predetermined extent from its upright position, towards a lying position, a pre-set actuating device in the unit automatically operates to cause an alarm signal to be emitted. Other features of the invention will become apparent from the following description.

BRIEF DESCRIPTION OF THE DRAWINGS

A preferred embodiment of the invention is shown in the accompanying drawings, wherein.

DETAILED DESCRIPTION OF THE PREFERRED EMBODIMENT

Figure 1:
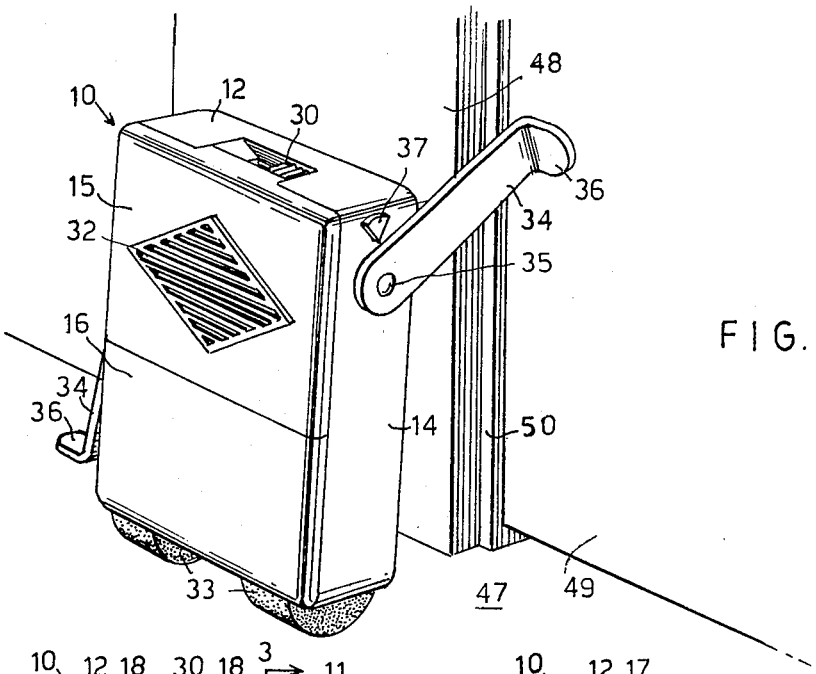
FIG. 1 is a perspective view of an alarm according to the invention, set up near a doorway.
Figure 2:
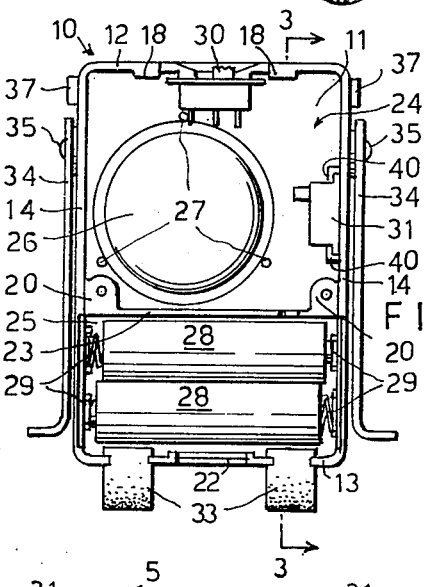
FIG. 2 is a front elevational view of the alarm with its upper and lower front plates removed.
Figure 3:
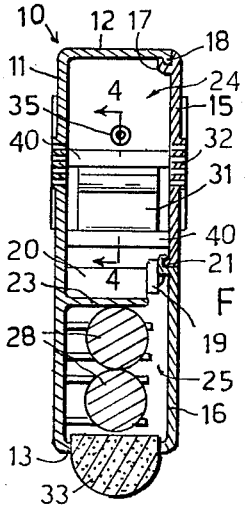
FIG. 3 is a cross-sectional view of the alarm, taken along line 3—3 in FIG. 2.
Figure 4:
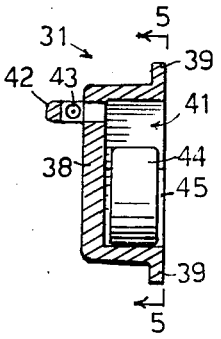
FIG. 4 is a sectional detail drawing, along line 4—4 in FIG. 3, and to larger scale, of the alarm switch of the device.
Figure 5:
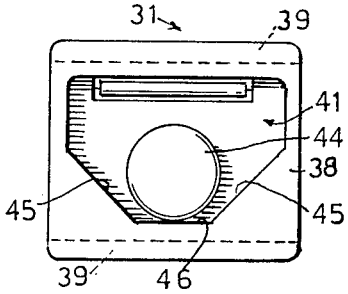
FIG. 5 is an elevational view of the alarm switch shown in FIG. 4, viewed in the direction of the arrows 5—5 in FIG. 4, and in inoperative position.

The alarm shown in the drawings includes a main body 10 which may be moulded integrally of a plastics material, and substantially of rectangular box-like form, of greater height than width, and of greater width than depth, and comprising a back 11, a top 12, a bottom 13 and two sides 14.

The front of the main body 10 is normally closed by an upper front plate 15 and a lower front plate 16. The upper front plate is held in place by the engagement of a pair of top hooked projections 17 with a pair of lugs 18 depending from the top 12 of the body, and by screws (not shown) through inset lower parts 19 of the upper front plate 15 and engaged in tapped apertures in a pair of bosses 20 within the main body 10. The lower front plate 16 has its upper part releasably engaged, as shown at 21, with the bottom of the upper front plate 15, its lower part being releasably engaged with the bottom 13 of the main body 10 by a resilient catch at 22, the lower front plate 16, when in position, covering and concealing the screws securing the upper front plate 15.

A transverse partition 23 within the main body 10 divides the body into an upper compartment 24 and a lower compartment 25. Within the upper compartment 24 an electric buzzer device 26 of well-known type is held by three equally spaced fingers 27 moulded integrally with the main body 10, and within the lower compartment 25, dry cells 28 for operating the buzzer are clipped between electrical contacts at 29. A recessed "on-off" switch 30 in the electrical circuit of the buzzer is mounted in and below the top 12 of the main body 10, and within the upper compartment 24 an alarm switch assembly indicated generally at 31, and more fully described later, is mounted adjacent to a side 14 of the main body and connected in the electrical circuit of the buzzer 26. Emission of the buzzer signal is facilitated by the provision of apertured sections 32 moulded in the upper front plate 15 and in the main body back 11.

The device is provided with two spaced-apart feet 33, each substantially of semi-cylindrical shape, made of a fairly soft and resiliently deformable material such as sponge rubber, these two feet having their upper parts engaged and held in apertures in the main body bottom 13. The feet are such that the device cannot be supported by them alone in a state of stable equilibrium.

Two oppositely arranged but otherwise similar stay arms 34 are pivoted at one end, by coaxial rivets 35, to the upper parts of the two sides 14 of the main body 10, the distal ends of these arms being bent laterally outwards to form rest lugs 36. Substantially triangular stops 37 formed on the upper parts of the body sides 14 limit the pivotal movement, in both directions, of the two stay arms 34. There is sufficient friction at the pivotal connections of the stay arms to prevent them from swinging freely, so they tend to remain in the positions to which they are moved manually.

Figure 6:
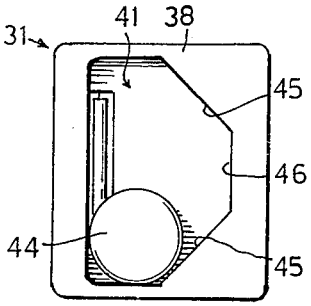
FIG. 6 shows the alarm switch, viewed from the same direction as in FIG. 5, but moved to one of its operative positions.

The alarm switch assembly 31 before referred to includes a housing 38 (FIGS. 4–5) of box-like form with a pair of opposed mounting flanges 39 slidably engaged with a pair of parallel guides 40 moulded on the inner face of a body side 14 so that a chamber 41 formed in the housing is closed by the adjacent side 14. Assuming the alarm to be upright, as shown in FIGS. 2, 3, 4 and 5, a hollow transverse projection 42 from the top of the housing 38 contains a magnetic reed switch 43 of well-known type, connected in the circuit of the buzzer. The chamber 41 contains a cylindrical permanent magnet 44. The two ends of the bottom of the chamber 41 are downwardly convergent, to form a guide track consisting of two ramps 45 inclining oppositely to a central part 46, so that, when the alarm device and the housing 38 are upright, the cylindrical magnet 44 is located on the central part 46 of the track, spaced well below the middle part of the magnetic reed switch 43, which consequently is open. If, however, the alarm device is swung over to front or back, through about 45° from its vertical position in either direction, the cylindrical magnet 44 will travel along the lower of the ramps 45 to one end of the tilted housing, as shown in FIG. 6, so that the magnet is brought to one end of the track within the chamber 41, and therefore close to an end of the magnetic reed switch 43, which consequently is closed.

In setting the alarm for operation, the device is held upright and the switch 30 is moved to its "on" position, the device, still held upright, then being placed on the floor 47 with its main body 10 a short distance away from a door architrave 48, the appropriate one of the stay arms 34 being swung out to rest lightly against the swinging stile portion of the door 49. The body 10 should be very nearly vertical so that, although it is in a condition of stable equilibrium because of the support given by the extended stay arm, a very slight inward movement of the door 49 will cause the alarm device to fall over immediately, resulting in the closing of the alarm switch 43, as before described, and the sounding of the buzzer. In most cases, the initial opening movement of the door will cause the device to fall over to lie on its front and emit the alarm signal, but as the stay arm 34 acted on by the door is at one side of the body 10, the alarm device may swivel and fall to lie with its back towards the floor and, of course, the buzzer will still sound.

If a newspaper should be delivered to the room by being pushed under the door, it will not strike and activate the alarm which is located to one side of the doorway, behind the architrave 48. If a thief, suspecting that the alarm has been installed, should, for example, insert under the door an L-shaped tool and endeavour to use it to clamp the alarm flat against the architrave 48 or the door 49, the alarm device will simply swivel and fall. Again, if a thief should insert a tool such as long-nosed pliers under the door to grip one of the feet 33 to hold the device upright while the door is being opened, the yielding nature of the feet 33 is such that they are not likely to be held firmly enough to prevent the device from tilting to cause the buzzer alarm to sound. Each of the stay arm lugs 34 is of such width that it cannot move between the door and the architrave to come to rest on the door stop 50.

The alarm is not likely to be set off accidentally by swivelling on a polished floor and falling, as the fairly soft and cellular nature of the feet 33 will prevent this. The spaced feet will enable the device to be set, without likelihood of its swivelling and falling, on even a fairly irregular or ridged floor surface.

The alarm device has the additional advantage of being well-suited to use as a portable alarm for a pedestrian. It may be carried upright in the hand, with the switch 30 pre-set to its "on" position and, in the event of an attack by a thief, it may be dropped to put the buzzer in operation, summoning aid and probably deterring the thief from remaining.

We claim:

1. A portable alarm including:

an alarm signal-emitting unit, a pair of base supports below the sides of the bottom of the unit adapted to support the unit, when upright, in a state of unstable equilibrium, a stay arm pivoted at one end to an upper part of a side of the unit and adapted to be rested against a door to impart stability to the unit when standing substantially upright on the base supports, the alarm otherwise being out of the path of movement of said door, and actuating means adapted, when the unit is moved to a predetermined extent from its upright position, to cause an alarm signal to be emitted from the unit.

2. A portable alarm including:

an alarm signal-emitting unit, base support means adapted to support the unit, when upright, in a state of unstable equilibrium, a pair of stay arms pivoted, at one end, to opposite sides of the unit, either one being adapted to be rested against a door to impart stability to the unit when standing substantially upright on the base support means, the alarm being otherwise out of the path of movement of said door, and actuating means adapted, when the unit is moved to a predetermined extend from its upright position, to cause an alarm signal to be emitted from the unit.

3. A portable alarm according to claims 1 or 2 wherein:

the base support means includes a pair of spaced feet of resiliently compressible material secured to and extending down from the bottom of the unit and with correspondingly curved bottom surfaces.

4. A portable alarm according to claims 1 or 2 wherein the alarm signal-emitting unit comprises:

a hollow body, an electrically operated signal emitter in the body, and an on-off switch on the body, connected in the electrical circuit of the signal emitter.

5. A portable alarm according to claims 1 or 2 wherein said actuating means comprises:

a magnetic reed switch connected in the electrical circuit of the signal emitter, a guide track, and a permanent magnet movable along the track, the guide track being adapted, when the alarm signal-emitting unit is moved to its upright position, to guide the magnet to move gravitationally to a position at which it is so spaced from the magnetic reed switch that said switch remains open, and when said unit is tilted through a predetermined angle, in either direction, from its upright position, to guide the magnet to move gravitationally to such position that it causes the magnetic reed switch to be closed.

* * * * *